US008235489B2

(12) United States Patent
Laaspere et al.

(10) Patent No.: US 8,235,489 B2
(45) Date of Patent: Aug. 7, 2012

(54) INK JETTING

(75) Inventors: Jaan T. Laaspere, Norwich, VT (US); Shubh Halwawala, Lebanon, NH (US); Samuel Darby, North Andover, MA (US); Sandra Graveson, Enfield, NH (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 73 days.

(21) Appl. No.: 12/125,702

(22) Filed: May 22, 2008

(65) Prior Publication Data

US 2009/0289986 A1 Nov. 26, 2009

(51) Int. Cl.
*B41J 29/38* (2006.01)

(52) U.S. Cl. ..... 347/13; 347/5; 347/9; 347/42; 347/43; 347/49

(58) Field of Classification Search ..... None
See application file for complete search history.

(56) References Cited

U.S. PATENT DOCUMENTS

| | | | | |
|---|---|---|---|---|
| 4,963,882 | A | 10/1990 | Hickman | |
| 5,265,315 | A | 11/1993 | Hoisington et al. | |
| 5,430,469 | A | 7/1995 | Shioya et al. | |
| 5,650,803 | A | 7/1997 | Tamura et al. | |
| 5,883,644 | A | 3/1999 | Nicoloff et al. | |
| 5,943,072 | A | 8/1999 | Robert et al. | |
| 5,984,455 | A | 11/1999 | Anderson | |
| 6,067,405 | A | 5/2000 | Serra | |
| 6,089,692 | A | 7/2000 | Anagnostopoulos | |
| 6,164,745 | A | 12/2000 | Nagoshi et al. | |
| 6,189,993 | B1 | 2/2001 | Mantell | |
| 6,260,939 | B1 | 7/2001 | Shioya et al. | |
| 6,264,298 | B1 | 7/2001 | Mantell | |
| 6,478,397 | B2 | 11/2002 | Chang et al. | |
| 6,481,820 | B1 * | 11/2002 | Tamura et al. | 347/19 |
| 6,513,906 | B1 | 2/2003 | Tanaka et al. | |
| 6,575,558 | B1 | 6/2003 | Grose et al. | |
| 6,776,468 | B2 | 8/2004 | Miller et al. | |
| 6,779,861 | B2 | 8/2004 | Mori | |

(Continued)

FOREIGN PATENT DOCUMENTS

EP 0 914 950 5/1999

(Continued)

OTHER PUBLICATIONS

U.S. Appl. No. 10/800,467, filed Mar. 15, 2004, Hasenbein et al.

(Continued)

*Primary Examiner* — Matthew Luu
*Assistant Examiner* — Justin Seo
(74) *Attorney, Agent, or Firm* — Fish & Richardson P.C.

(57) ABSTRACT

Among other things, for jetting ink droplets on a substrate during relative motion of an apparatus and the substrate along a process direction, a first and second jetting assemblies at least partially overlap in a direction perpendicular to the process direction so that some jets in the first jetting assembly align with some jets in the second jetting assembly along the process direction to form one or more pairs of aligned jets. A mechanism enables, in at least one pair of the aligned jets, one jet to jet a first ink drop that has a size smaller than a size of an ink drop the jet would otherwise be required to jet to form a desired pixel and the other jet to jet a second ink drop that has a size sufficient to form the desired pixel in combination with the first ink drop.

19 Claims, 7 Drawing Sheets

U.S. PATENT DOCUMENTS

| | | | | |
|---|---|---|---|---|
| 6,837,574 | B2 | 1/2005 | Yamada et al. | |
| 7,281,778 | B2 | 10/2007 | Hasenbein et al. | |
| 2005/0088483 | A1 * | 4/2005 | Powers et al. | 347/43 |
| 2005/0270329 | A1 | 12/2005 | Hoisington et al. | |
| 2006/0007257 | A1 | 1/2006 | Chiwata | |
| 2006/0012631 | A1 | 1/2006 | Niekawa | |
| 2006/0170730 | A1 | 8/2006 | Rogers | |
| 2006/0203022 | A1 | 9/2006 | Mizuno | |
| 2007/0120883 | A1 | 5/2007 | Tsuboi | |
| 2009/0289986 | A1 | 11/2009 | Laaspere et al. | |
| 2011/0007107 | A1 | 1/2011 | Hosington et al. | |

FOREIGN PATENT DOCUMENTS

| | | |
|---|---|---|
| JP | 2002-144542 | 5/2002 |
| JP | 2004009549 | 1/2004 |
| JP | 2004148689 | 5/2004 |
| JP | 2005-199692 | 7/2005 |
| WO | 2009/142894 | 11/2009 |

OTHER PUBLICATIONS

U.S. Appl. No. 11/652,325, filed Jan. 11, 2007, Letendre et al.
U.S. Patent Application Serial No. Not Yet Assigned, "Cavity Plate", filed May 22, 2008, Marlene McDonald, application attached.
International Search Report and Written Opinion dated Sep. 30, 2009 from corresponding international application PCT/US2009/043279.
International Preliminary Report on Patentability dated Dec. 2, 2010 issued in international application No. PCT/US2009/043279, 5 pp. (168WO1).
Non-final Office Action received in related U.S. Appl. No. 12/500,560 dated Jul. 14, 2011, 8 pgs.

* cited by examiner

INK JETTING

TECHNICAL FIELD

This description relates to ink jetting.

BACKGROUND

Ink jetting can be done using an ink jetting printhead that includes jetting assemblies. Ink is introduced into the ink jetting printhead and when activated, the jetting assemblies jet ink and form images on a substrate.

SUMMARY

In one aspect, for jetting ink droplets on a substrate during relative motion of an apparatus and the substrate along a process direction, the apparatus includes first and second jetting assemblies each including an array of jets. The first and second jetting assemblies at least partially overlap in a direction perpendicular to the process direction so that some of the jets in the first jetting assembly align with some of the jets in the second jetting assembly along the process direction to form one or more pairs of aligned jets. The apparatus also includes a mechanism to enable, in at least one pair of the aligned jets, one jet to jet a first ink drop that has a size smaller than a size of an ink drop the jet would otherwise be required to jet to form a desired pixel on the substrate and the other jet to jet a second ink drop that has a size sufficient to form the desired pixel in combination with the first ink drop.

In another aspect, forming ink droplets on a substrate during relative motion of an ink jetting device and the substrate along a process direction, a method includes (a) causing a first jetting assembly of the ink jetting device to jet a first ink drop that has a size smaller than a size of an ink drop jet would otherwise be required to jet to form a desired pixel on the substrate; and (b) causing a second jetting assembly of the ink jetting device to jet a second ink drop that has a size sufficient to form the desired pixel in combination with the first ink drop.

Implementations may include one or more of the following features. The first and second jetting assemblies each comprises more than 100 jets. One or more jets in the first jetting assembly each aligns with a corresponding jet in the second jetting assembly along the process direction. Each jet in the first jetting assembly aligns with a corresponding jet in the second jetting assembly. Each jet in the first and second jetting assemblies is capable of jetting ink drops with more than one size. Each jet in the first and second jetting assemblies is capable of jetting ink drops with three different sizes. Each jet in the first and second jetting assemblies is capable of jetting ink drops with a drop size of 30 nano-grams, 50 nano-grams, or 80 nano-grams. The first ink drop and the second ink drop having a total drop size of about 50 nano-grams. The aligned jets in the first and second jetting assemblies are about 50 mm from each other along the process direction. The apparatus also includes first and second jetting assembly arrays each comprising one or more jetting assemblies, along the direction perpendicular to the process direction, the first array of jetting assemblies aligning with the first jetting assembly and the second array of jetting assemblies aligning with the second jetting assembly. Each jetting assembly in the first jetting assembly array overlaps at least partially with at least one of the jetting assemblies in the second jetting assembly array along the direction perpendicular to the process direction. Each jetting assembly in the first jetting assembly array overlaps at least partially with two jetting assemblies in the second jetting assembly array along the direction perpendicular to the process direction. Each jetting assembly includes more than one jet each aligning with a corresponding jet in a corresponding overlapping jetting assembly. The first and second arrays of jetting assemblies have a width of about 25 mm to about 1 m along the direction perpendicular to the process direction.

Implementations may also include one or more of the following features. The step (a) includes jetting a first ink drop having a drop size half of the size of the drop that is required to print the desired pixel on the substrate. The step (a) includes jetting a first ink drop having a drop size a third of the size of the drop that is required to print the desired pixel on the substrate. The first ink drop and the second ink drop to have a total drop size of about 50 nano-grams.

These and other aspects and features can be expressed as methods, apparatus, systems, means for performing a function, and in other ways.

Other features and advantages will be apparent from the following detailed description, and from the claims.

DESCRIPTION

Figure 2:
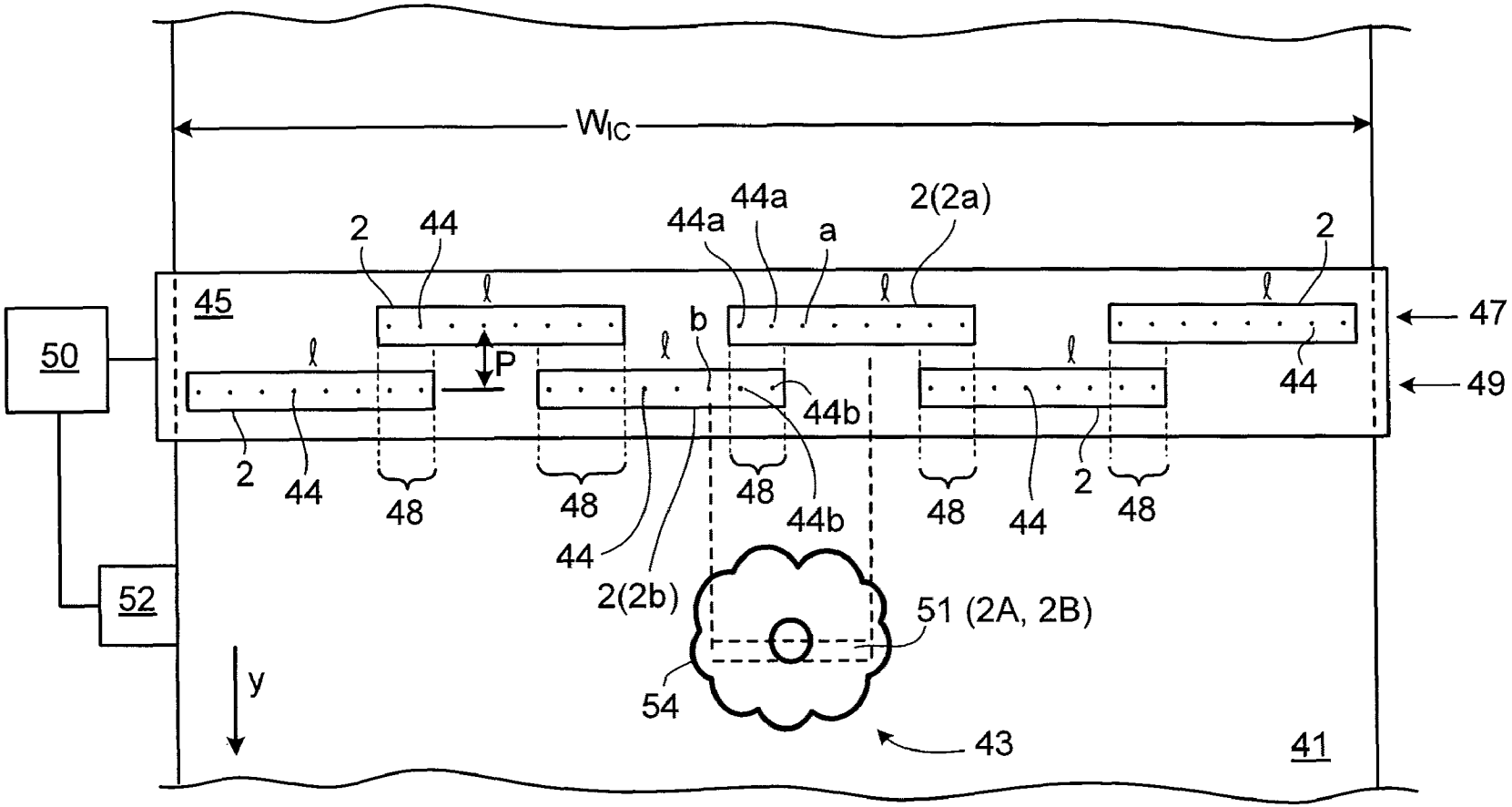
FIGS. 2 and 3 are schematic top views of ink jet printers.
Figure 2A:
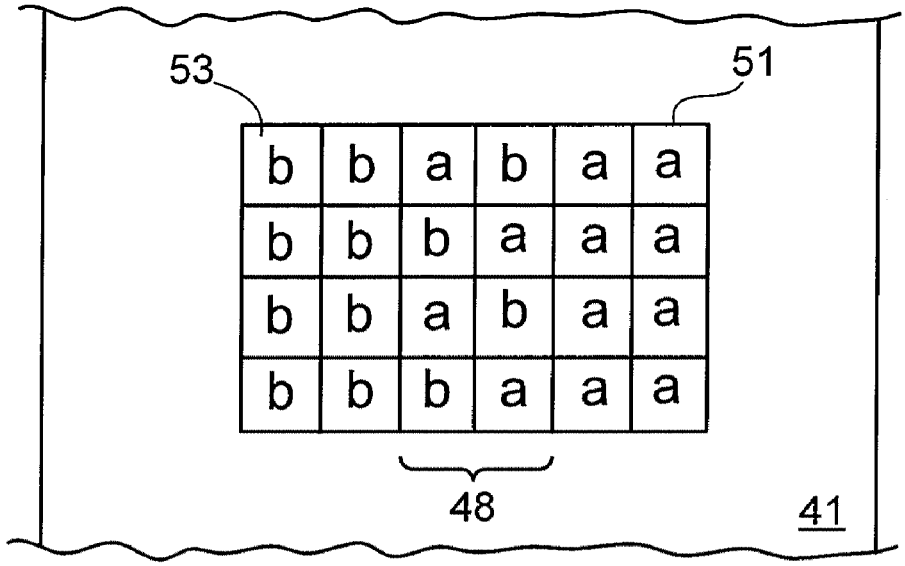
Figure 2B:
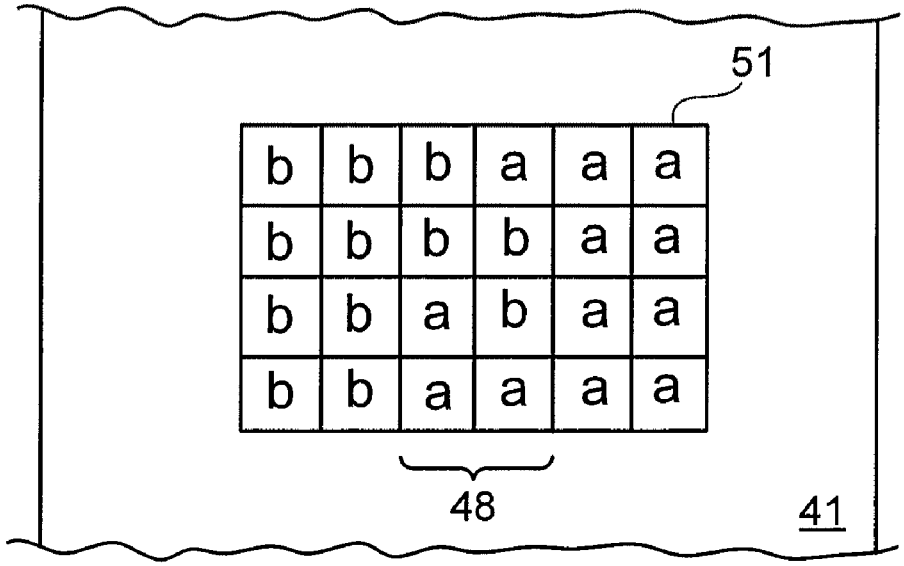
Figure 2C:
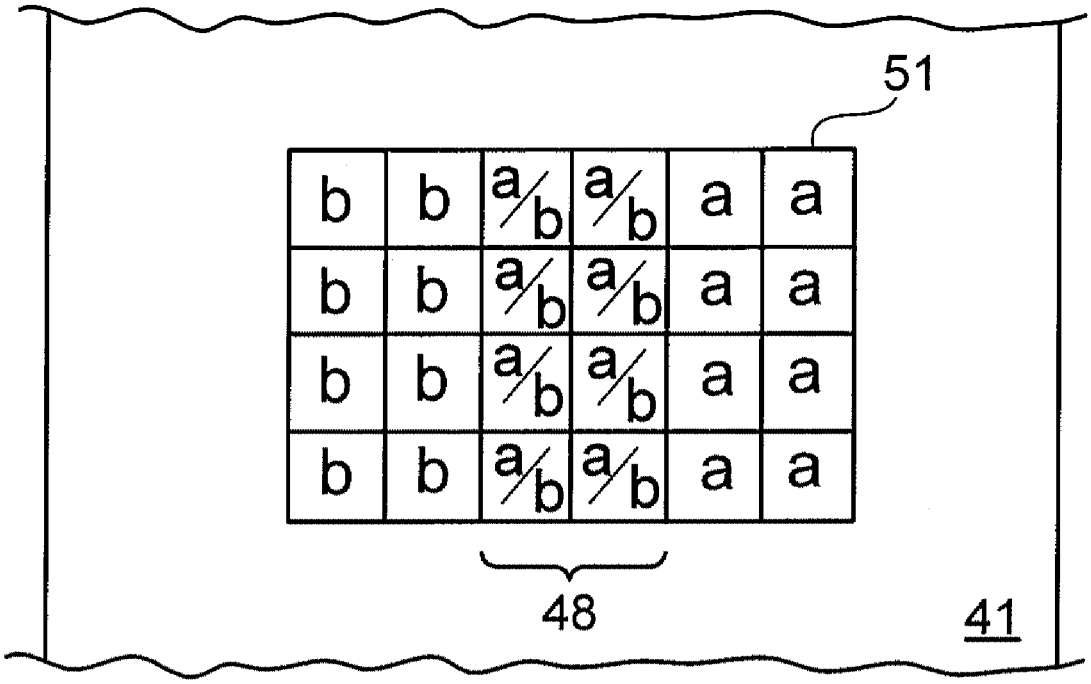

FIGS. 2A, 2B, and 2C are portions of a printed image schematically segmented in pixels.

Figure 1A:
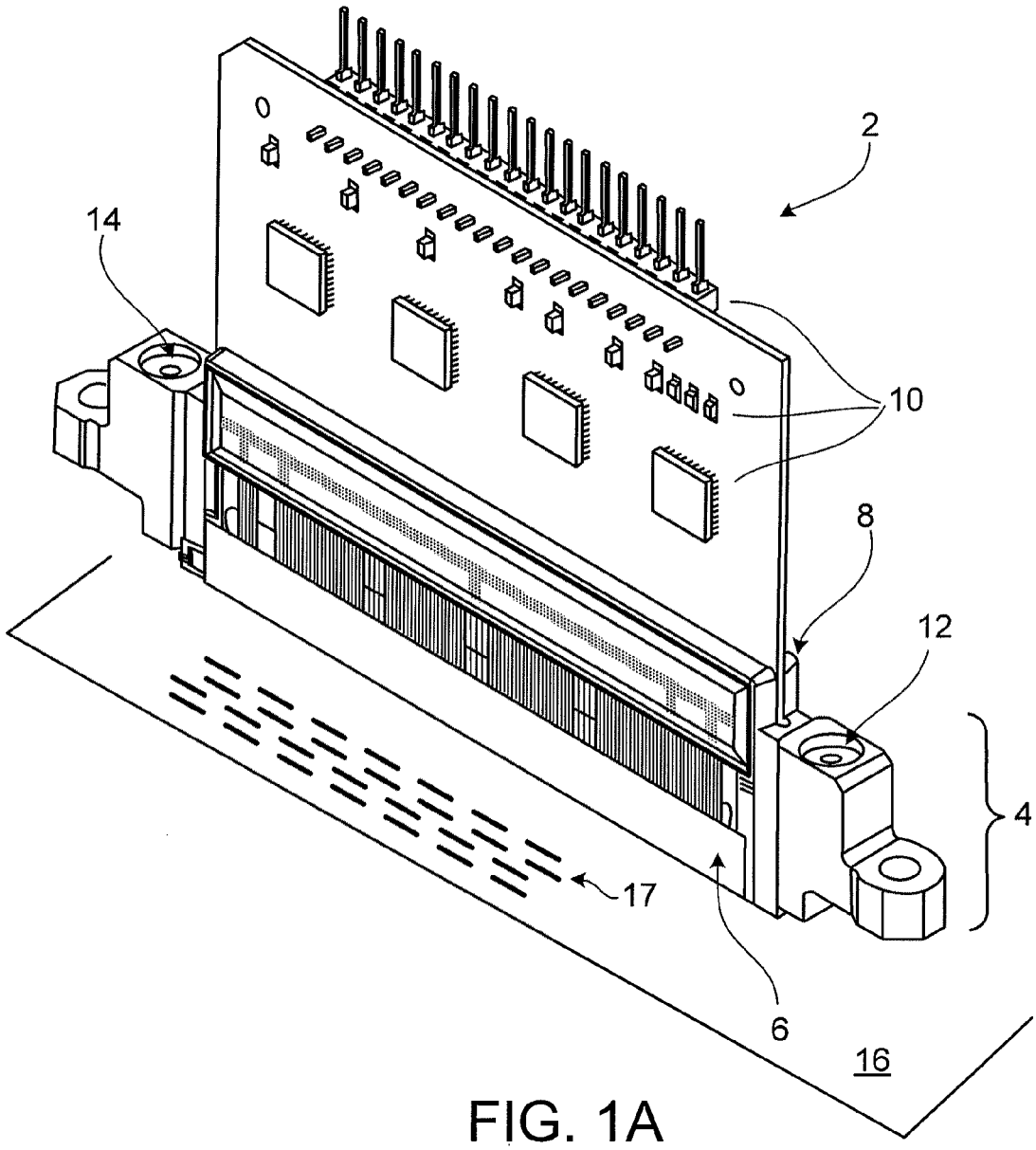
FIGS. 1A, 1B and 1C are exploded perspective views of ink jetting printheads and a portion of an ink jetting printhead.

Referring to FIG. 1A, ink jetting can be done using an ink jetting printhead 2 that includes assemblies 6 and 8 assembled onto a body 4 made, for example, of silicon or carbon. Ink is introduced into the ink jetting printhead 2 through the ink inlets 12 and 14 of the body 4. The ink jetting printhead 2 also includes electronic components 10 that activate the assemblies 6 and 8 to jet ink and form images 17 on a substrate 16.

Figure 1B:
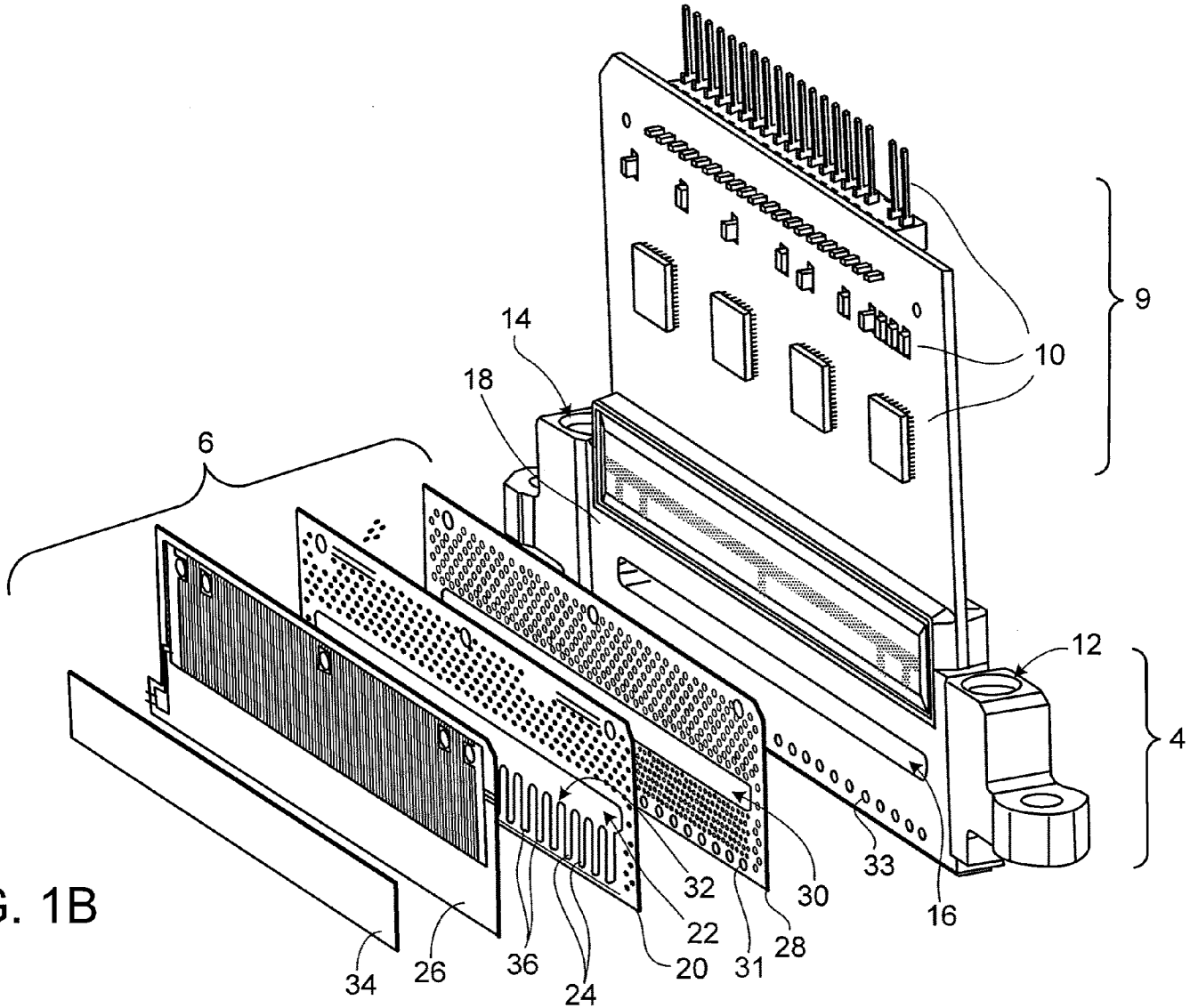
Figure 1C:
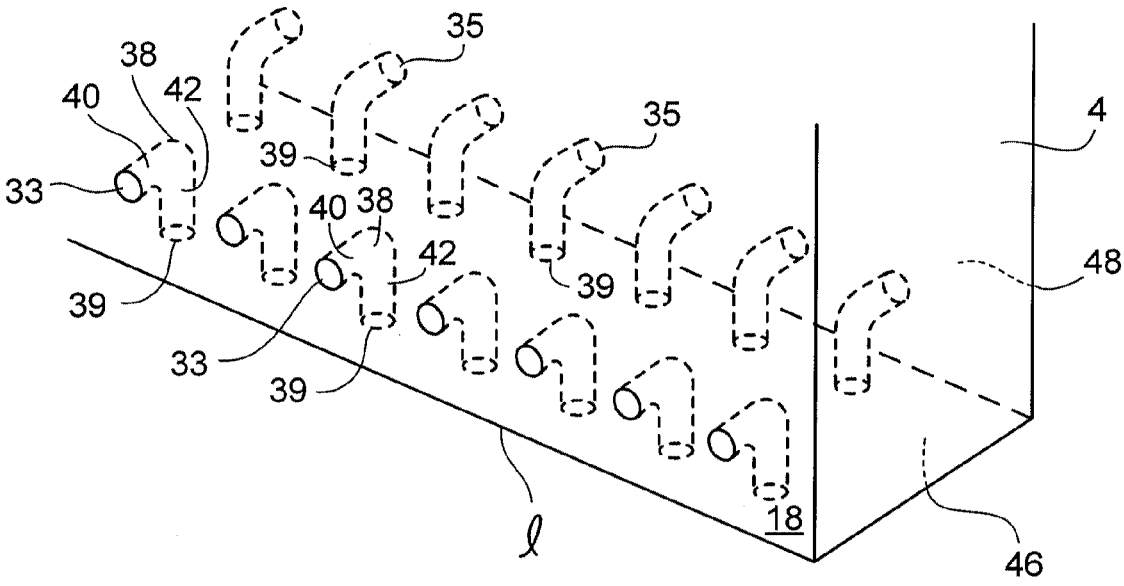

Referring to FIG. 1B, the body 4 includes a cavity 16 connected to the ink inlets 12 and 14 to form ink fill passage when the assemblies 6 and 8 (not shown) are assembled onto a surface 18 and its opposite surface 48 (FIG. 1C) of the body 4, respectively. On each of the surfaces 18 and 48, each opening in a row of openings 33 or 35 (FIG. 1C) is connected to an ink jetting passage 38 and an opening 39 in the body 4 (FIG. 1C). The jetting assemblies 6 and 8 (not shown) each includes a cavity plate 20 having a cavity 22 with dimensions and location matching the dimensions and location of cavity 16 projected in the surface 18 and an array of cavities 24 having top ends 32 open to the cavity 16 and jetting ends 36.

The front and back surfaces of the cavity plate 20 are covered by a dimensionally matching polymer film 26 and a stiffener plate 28, respectively, and ink pumping chambers are formed by the cavities 24. Similar to the cavity 22 on the cavity plate 20, the stiffener plate 28 also includes a cavity 30 so that when assembled and in use, ink is filled from the ink passage formed by the cavity 16 through the top ends 32 into the pumping chambers formed by the cavities 24. The stiffener plate 28 also includes a row of openings 31. When assembled, the dimensions and relative location of the openings 31 match those of the jetting ends 36 on the cavity plate and those of the openings 33 on the surface 18 of the body 4 so that when ink is pumped in the pumping chamber and reaches the jetting ends 36, it passes the openings 31 in the stiffener plate 28 and the corresponding openings 33 on the body 4 and flows into the ink jetting passages 40 in the body 4, where it is jetted from the openings 39 (FIG. 1C).

Referring to FIG. 1C, each of the ink jetting passages 38 corresponds to one pumping chamber in the assembly 6 or 8 (FIGS. 1A and 1B) and includes a horizontal portion 40 connected to an opening 33 or 35 and a vertical portion 42 connected to an opening 39 on the bottom 46 of the body 4. The openings 33 and 35 are staggered along a long dimension 1 of the body 5 and when projected onto one of the surfaces 18 and 48, the projection forms a row of equally distanced openings. The openings 39 are also equally distanced from each other and can be aligned in one (not shown) or two rows parallel to the long dimension 1 of the body 4. In the example shown in the figure, the openings 39 in different rows are staggered along the long dimension 1 of the body 4. One of the two rows of the openings 39 is connected to openings 35 in the back surface 48 of the body and the other row is connected to openings 33 in the front surface 18 of the body through the ink jetting passages 38.

In some embodiments, an orifice plate (not shown) containing orifices can be attached to the bottom 46 of the body 4. Each orifice in contact with the bottom 46 of the body 4 aligns with an opening 39 and the orifices can be arranged, for example, in one or two rows corresponding to the number of rows in which the openings 39 are arranged. The orifices are connected to channels that are built within the orifice plate, which have another end connected to openings aligned in a single row in another surface of the orifice plate. Ink is jetted out to the substrate beneath the orifice plate through the single row of openings. Each pumping chamber, its corresponding ink jetting passage 38, opening 39 and orifice together form an ink jet 44 (not shown).

Referring back to FIG. 1B, a piezoelectric element 34 having, for example, a thickness of about 200 microns, is attached to the outer surface of the polymer film 26 and covers the pumping chambers. The piezoelectric element 34 includes electrodes (not shown) that are electrically connected to the electronic components 10 on a flex board 9 that is assembled onto the body 4. When in use, the electronic components 10 send signals, for example, voltage pulses, to selected electrodes and activate the portions of the piezoelectric element 34 that correspond to the selected electrodes to change shape and apply to pressures to the corresponding pumping chambers to jet ink.

The resolution at which the printhead 2 prints depends, for example, on the size and density of the pumping chambers in the jetting assemblies 6 and 8. In the example shown in the figures, the jetting assemblies 6 and 8 each has more than 50, 64, 100, 128, 256, 500, or 512 elongated parallel pumping chambers each having a length of about 5 mm, width of about 200 microns. The maximum width the printhead 2 can print is about 20 mm to about 100 mm. Information about the ink jetting printhead is also provided in U.S. Ser. No. 12/125,648 which is filed on May 22, 2008 and published as U.S. Patent Application Publication no. 2009/0290000).

Referring to FIG. 2, one or more printheads 2 (two of the printheads 2 are named as 2*a* and 2*b;* the total number of printheads 2 and the number of jets in each printhead 2 shown are schematic) of FIG. 1A capable of printing, for example, at the same maximum resolution, can be incorporated into what is called a single-pass ink jet printer 45. During printing, the printer 45 is kept still and based on the information about an image 43 obtained before printing and instantaneous information about motion of the substrate sent from a detector 52, a controller 50 sends signals to the electronic components 10 (FIGS. 1A and 1B) of each printhead 2 to activate the relevant pumping chambers to jet ink at proper locations of a substrate 41 that is passing beneath the printer 45 and moving along a process direction y.

The multiple printheads 2 are staggered in associated rows, for example, rows 47 and 49, with their long dimensions 1 aligned across the substrate 41, for example, perpendicular to the process direction y to cover the substrate width $W_{1C}$ ranging from less than 25 mm to 1 meter or more. Each printhead 2 in one of the rows 47 and 49 overlaps with at least one, for example, two, printhead 2 in the other row in stitching zones 48. Each stitching zone 48 includes about 1 to about 4 jets 44, or even more, for example, 16 jets 44 of each printhead 2, in which each jet 44 of one printhead 2, for example, jet 44*a,* aligns with a corresponding jet 44 of an overlapping printhead 2, for example, jet 44*b,* along the process direction y.

In some embodiments, each pixel, for example, pixel 54 of the image 43 is printed by a single jet 44 of the printheads 2 that is capable of jetting ink drops with one desired uniform size. For example, one type of printhead 2 is capable of jetting ink drops each having a mass of about 30 nano-grams, another type of printhead 2 capable of jetting ink drops each having a mass of about 50 nano-grams, or still another type of printhead 2 capable of jetting ink drops each having a mass of about 80 nano-grams. In particular, ink is jetted only from one of the overlapping jets, for example, either jet 44*a* or jet 44*b,* to print each pixel of the image 43 that is on the part of the substrate 40 passing beneath the stitching zones 48 along the process direction y. The selection of which one of the two aligned jets 44 can be random or regular, for example, taking turns, configured, for example, by the controller 50.

Referring to FIGS. 2A and 2B, a portion 51 of the image 43 is printed on the substrate 41 using the two overlapping printheads 2 (printhead 2*a* with jets labeled as a in the row 47 and printhead 2*b* with jets labeled as b in the row 49). Each pixel of the portion 51 is enlarged and represented by a square 53. In the example shown in the figures, two columns of the pixels fall into the stitching zone 48, each printed by a one of the aligned jets 44(*a* or *b*) taking turns (FIG. 2A), or randomly (FIG. 2B). Out of the stitching zone 48, each of the pixels is printed by one available jet a or b.

Printing with ink drops from one of the two aligned jets in each of the stitching zones 48 smoothes the seam between portions of images printed by different printheads across the substrate 41 and reduces or masks the undesired low quality printing, for example, streaks or image artifacts, caused by the possible misalignment of the printheads 2 in neighboring arrays both along and perpendicular to the process direction y, by the possible differences in properties between different printheads, which ideally would be identical, or by crooked or missing jets on one or more printheads.

Referring to FIG. 2C, when printing the portion 51 of the image 43 (FIG. 2), some of the pixels, for example, pixels printed by the jets 44 in the stitching zones 48, each can also be printed cooperatively by both of the aligned jets 44 along the process direction y. In some embodiments, the controller 50 is configured to allow the electronic components 10 of each printhead 2 to send voltage pulses having selected multiple waveforms at controlled frequencies to activate the pumping chambers and jet ink drops that have different properties, e.g., sizes, from each jet 44. For example, each jet 44 of the printhead 2 is capable of jetting an ink drop having a mass that is, for example, ½, ⅓, or ¼ of the mass of the ink drop that a jet, capable of jetting ink drops with only one desired uniform size, of a printhead having the same physical properties, such as dimensions and densities of the pumping chambers. For example, such jet 44 can jet ink drops having a drop size of about 10 nano-grams to about 30 nano-grams, about 50 nano-grams, or about 80 nano-grams. In some embodiments, the smallest ink drop that the jet 44 is capable of jetting has a size that is about, for example, 10%, 20%, 25%, or 30%, and/or up to about, for example, 50%, 60%, 70%, 80%, or 90% of the size of the largest ink drop the jet 44 is capable of jetting. Information about printheads with jets capable of jetting ink drops having different properties is also provided in U.S. Ser. No. 10/800,467, which is filed on Mar. 15, 2004 and issued as U.S. Pat. No. 7,281,778 and U.S. Ser. No. 11/652,325, which is filed on Jan. 11, 2007 and published as U.S. Application Publication no. 2008/0170088, which are incorporated here by references.

In the example shown in the figures, the two aligned jets 44, in particular, a and b of printhead 2*a* and 2*b* of FIG. 2 jet ink drops to cooperatively print one pixel prints a fraction of the pixel. For example, one of the overlapping jets 44, e.g., jet 44*a* jets ink drops having a drop size that is, e.g., half, a third, a fourth, a fifth, or other fraction of the size of an ink drop that is required to print a desired pixel. The controller 50 is configured, based on the transport speed of the substrate 41 and the relative distance p between the aligned jets 44 along the process direction y, to activate the other one of the overlapping jets 44, e.g., jet 44*b*, at a proper time to jet ink drops that each compensates the size of the corresponding one of the ink drops that is already jetted to complementarily print the complete desired pixel on the substrate. The jets 44 that are not in the stitching zones 48, although also capable of printing fractions of a pixel, jet ink drops to print full pixels of the image 43 on the substrate 41. The use of both aligned jets in the stitching zones 48 obscures the quality difference of the portions of image 43 printed from different printheads 22 across the substrate 41 near the seams and enhances the overall quality of the image 43. Also, jetting ink from both aligned jets 44 in the stitching zones 48 reduces the possible poor image quality caused by malfunctioning, for example, crooked or weak, jets of one of the overlapping printheads 2 in the stitching zones 48.

Figure 3:
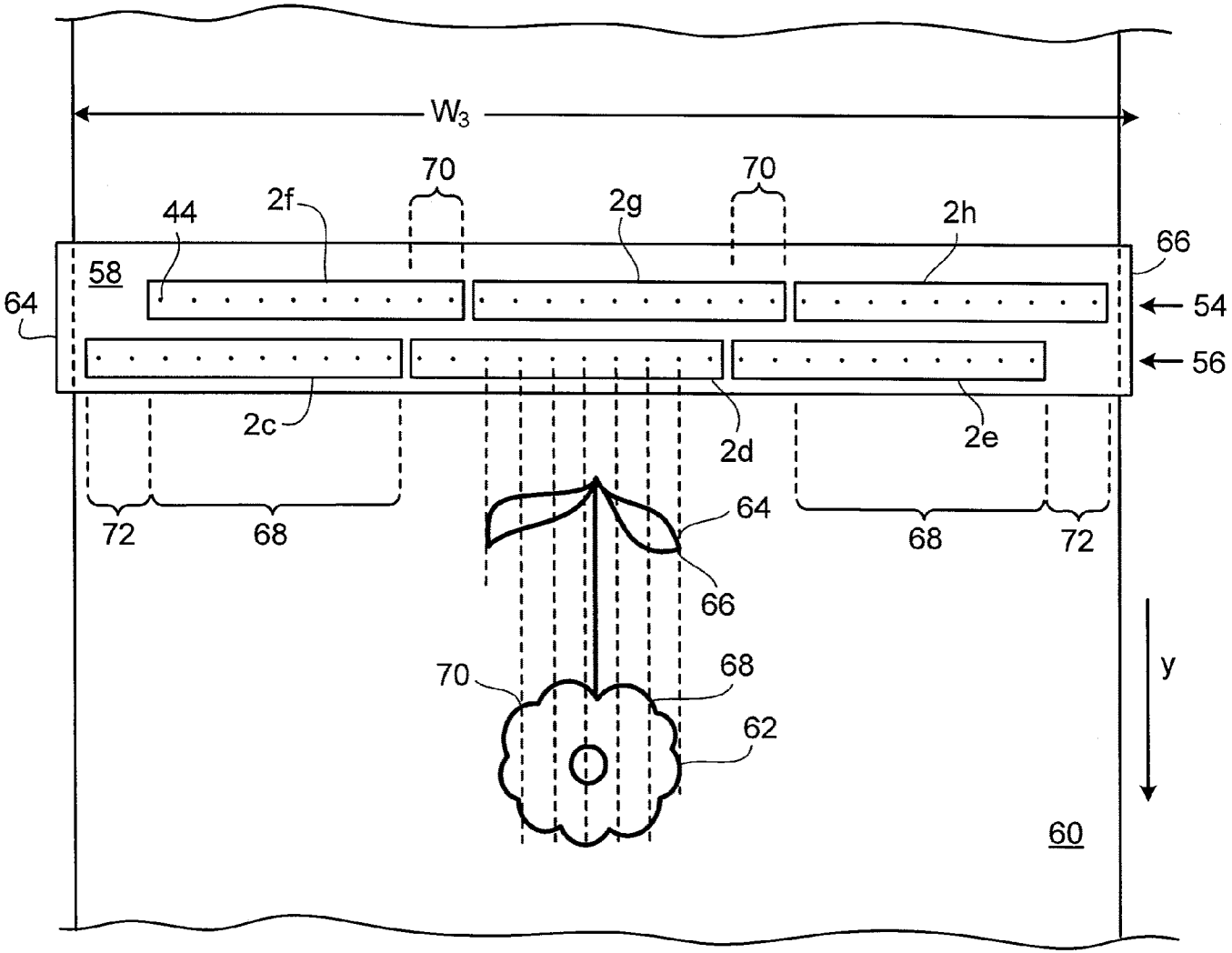

Referring to FIG. 3, in a printhead arrangement shown in a printer 58, the printheads 2, for example, six printheads 2 named as printheads 2*c*-2*h*, each including jets 44 (the total number of jets 44 shown is schematic) that are capable of jetting ink drops with one or more properties, e.g., sizes, as described above, can be arranged in two associated rows 54 and 56 in a single-pass ink jet printer 58. Each jet 44 of at least one printhead 2 aligns with a corresponding jet of overlapping printheads 2 along the process direction y. In the example shown in the figure, except the printheads 2*c* and 2*h*, which are arranged nearby the two long ends 64 and 66 of the printer 58, respectively, each of the printheads 2*b*-2*e* includes two stitching zones 68 and 70 that are similar to the stitching zone 48 of FIG. 2.

Each of the stitching zones 68 and 70 contains jets 44 from overlapping printheads aligned in the process direction y. One of the stitching zones 68 and 70 can include a number of, for example, 0, 1, 2, and up to about half of the total number of jets 44, each aligned with a corresponding jet of one overlapping printhead and the other one of the stitching zones 68 and 70 of the same printhead includes the rest of the jets 44 aligned with corresponding jets of another overlapping printhead.

The printheads 2*c* and 2*h* each contains a dangling zone 72, in which the jets 44 do not have corresponding aligned jets in the process direction y. The total number of jets 44 in each dangling zone 72 is dependent on the total number of aligned jets in each stitching zones 70. In some embodiments, when the stitching zone 70 contains zero aligned jets 44, each printhead in the row 54 fully overlaps with a corresponding printhead in the row 56 and dangling zone 72 does not exist.

In some implementations, more or less than six printheads 2*a*-2*f* can be used in the way described above, depending on the width $W_3$ of a substrate 60 the printer 58 is required to cover to print an image 44 on the substrate 60. The printer 58 can be configured so that when each jet 44 is capable of jetting ink drops with only one desired uniform property, each pixel, e.g., pixel 64, 66, 68, or 70, of the image 62 is printed with ink jetted from only one of the two aligned jets 44 along the process direction y. When each jet 44 is capable of jetting ink drops with two or more properties, each pixel of the image 62 is printed cooperatively with ink jetted from both aligned jets 44 along the process direction y. The extensive overlapping of printheads in the printer 58 allows a large number of jets 44 in the printer to have an aligned corresponding jet along the process direction y to further reduce the possible poor image quality caused by malfunctioning, for example, crooked or weak, jets of one of the printheads and blur the quality difference of portions of the image 62 printed from different printheads.

Other embodiments are also within the scope of the following claims.

For example, the printers 45 and 48 each can include more coupled printhead rows like printhead rows 47 and 49 and printhead rows 54 and 56, stacked along the process direction y. Each pair of rows can print a different color than the other pairs. In each of the printers 45 and 48, each printhead 2 can have its long dimensions 1 form an angle different than 90 degrees with the process direction y. Printheads other than that described in FIG. 1A can be used, for example, printheads that are made of sintered carbon or silicon and described in U.S. Pat, No. 5,265,315 and U.S. Ser. No. 12/125,648, which is filed on May 22, 2008 and published as U.S. Patent Application Publication no. 2009/0290000, which are incorporated here by reference.

When there is little or no jetting in the printer 45 or 48, ink recirculation can be done by letting ink flow slowly in one of the two ink inlets 12 and 14 of each printhead 2 through the ink passage 16 and out the other one of the ink inlets 12 and 14.

It should be understood that reference to ink as the printing fluid was for illustrative purposes only, and referring to components within the jetting assemblies described above with the adjective "ink" was also illustrative. The jetting assemblies can be used to dispense or deposit various printing fluids other than ink onto a substrate. The fluids can include non-image forming fluids. For example, three-dimensional model pastes can be selectively deposited to build models. Biological samples can be deposited on an analysis array.

What is claimed is:

1. An apparatus for use in jetting ink droplets on a substrate during a relative motion of the apparatus and the substrate along a process direction, the apparatus comprising:

two rows of jetting assemblies, a first row of the two rows of jetting assemblies comprising a first jetting assembly and one or more additional jetting assemblies, and a second row of the two rows of jetting assemblies comprising a second jetting assembly and one or more additional jetting assemblies, each row of the jetting assemblies including an array of jets, the two rows of jetting assemblies at least partially overlapping in a direction perpendicular to the process direction so that, except for one or more jets at one or both ends of at least one row, each of the jets in each row of the jetting assemblies aligns with a corresponding jet in a jetting assembly of the other row of jetting assemblies along the process direction to form a pair of aligned jets, for each of at least some of the pairs of aligned jets, the jet in a first row of the two rows of jetting assemblies and the corresponding jet in a second row of the two rows of jetting assemblies being configured to jet ink drops of more than one size; and a mechanism to enable, in each pair of the aligned jets, one jet to jet a first ink drop that has a size smaller than a size of an ink drop the jet would otherwise be required to jet to form a desired pixel on the substrate, the size of the first ink drop being smaller than a maximum drop size that the one jet is configured to jet, and the other jet to jet a second ink drop that has a size sufficient to form the desired pixel in combination with the first ink drop.

2. The apparatus of claim 1 in which the first and second jetting assemblies each comprises more than 100 jets.

3. The apparatus of claim 1 in which more than 4 jets in the first jetting assembly each aligns with a corresponding jet in the second jetting assembly along the process direction.

4. The apparatus of claim 1 in which each jet in the first jetting assembly aligns with a corresponding jet in the second jetting assembly or in an additional jetting assembly in the second row.

5. The apparatus of claim 1 in which the size of the second ink drop is smaller than a maximum drop size that the other jet is configured to jet.

6. The apparatus of claim 1 in which each jet in the first and second jetting assemblies is configured to jet ink drops of three different sizes.

7. The apparatus of claim 1 in which each jet in the first and second jetting assemblies is configured to jet ink drops having a drop size of 30 nano-grams, 50 nano-grams, or 80 nano-grams.

8. The apparatus of claim 1 in which each jet in the first and second assemblies is configured to jet ink drops having a drop size of 10 nano-grams to 30 nano-grams.

9. The apparatus of claim 1 in which the first ink drop and the second ink drop have a total drop size of 50 nano-grams.

10. The apparatus of claim 1, the aligned jets in the first and second rows of jetting assemblies are 50 mm from each other along the process direction.

11. The apparatus of claim 1 in which each jetting assembly in the first row of jetting assemblies overlaps at least partially with at least one of the jetting assemblies in the second row of jetting assemblies along the direction perpendicular to the process direction.

12. The apparatus of claim 1 in which each jetting assembly in the first row of jetting assemblies overlaps at least partially with two jetting assemblies in the second row of jetting assemblies along the direction perpendicular to the process direction.

13. The apparatus of claim 1 in which each jetting assembly in the first row of jetting assemblies includes more than one jet, each of the more than one jet in the first row of jetting assemblies aligning with a corresponding jet in a corresponding jetting assembly in the second row of jetting assemblies.

14. The apparatus of claim 1 in which the first and second rows of jetting assemblies have a width of 25 mm to 1 m along the direction perpendicular to the process direction.

15. A method for forming ink droplets on a substrate during a relative motion of an ink jetting device and the substrate along a process direction, the ink jetting device comprising two rows of jetting assemblies, each row comprising two or more jetting assemblies and the two rows at least partially overlap in a direction perpendicular to the process direction, so that except for one or more jets at one or both ends of at least one row, each of the jets in each row of jetting assemblies aligns with a corresponding jet in a jetting assembly of the other row of jetting assemblies along the process direction to form a pair of aligned jets, the method comprising:

(a) causing each jet, that belongs to a pair of aligned jets, along one of the rows of jetting assemblies to jet a first ink drop that has a size smaller than a size of an ink drop that the jet would otherwise be required to jet to form a desired pixel on the substrate, each jet along the row being configured to jet ink drops of more than one size, and the size of the ink drop being smaller than a maximum drop size that the jet is configured to jet; and (b) causing a jet, that belongs to the pair of aligned jets and that is located along the other row of jetting assemblies, to jet a second ink drop that has a size sufficient to form the desired pixel in combination with the first ink drop, each jet of the other row of jetting assemblies being configured to jet ink drops of more than one size.

16. The method of claim 15 in which the step (a) includes jetting a first ink drop having a drop size half of the size of the drop that is required to print the desired pixel on the substrate.

17. The method of claim 15 in which the step (a) includes jetting a first ink drop having a drop size a third of the size of the drop that is required to print the desired pixel on the substrate.

18. The method of claim 15 in which the first ink drop and the second ink drop have a total drop size of 50 nano-grams.

19. The method of claim 15 in which the size of the second ink drop is smaller than a maximum drop size that each jet of the second row of jetting assemblies is configured to jet.

* * * * *